US010289056B2

(12) United States Patent
Izaki et al.

(10) Patent No.: US 10,289,056 B2
(45) Date of Patent: May 14, 2019

(54) IMAGE FORMING APPARATUS

(71) Applicant: CANON KABUSHIKI KAISHA, Tokyo (JP)

(72) Inventors: Yu Izaki, Suntou-gun (JP); Tomoaki Nakai, Numazu (JP); Yusaku Iwasawa, Mishima (JP); Takamitsu Soda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 15/701,190

(22) Filed: Sep. 11, 2017

(65) Prior Publication Data

US 2018/0074451 A1 Mar. 15, 2018

(30) Foreign Application Priority Data

Sep. 13, 2016 (JP) ..... 2016-178957

(51) Int. Cl.

| | |
|---|---|
| ***G03G 21/16*** | (2006.01) |
| ***G03G 15/00*** | (2006.01) |
| ***G03G 15/02*** | (2006.01) |
| *G03G 15/16* | (2006.01) |
| *G03G 21/00* | (2006.01) |

(52) U.S. Cl.

CPC ..... *G03G 15/80* (2013.01); *G03G 15/0283* (2013.01); *G03G 15/161* (2013.01); *G03G 15/168* (2013.01); *G03G 21/0017* (2013.01)

(58) Field of Classification Search

CPC ..... G03G 15/161; G03G 15/1675; G03G 15/1605; G03G 15/80; G03G 2215/0177; G03G 21/1647; G03G 21/1842

See application file for complete search history.

(56) References Cited

U.S. PATENT DOCUMENTS

| | | | | |
|---|---|---|---|---|
| 2012/0045231 A1* | 2/2012 | Ogino | G03G 15/1675 | 399/45 |
| 2014/0147146 A1* | 5/2014 | Kobayashi | G03G 15/161 | 399/66 |
| 2015/0338791 A1* | 11/2015 | Matsushita | G03G 15/1615 | 399/66 |

FOREIGN PATENT DOCUMENTS

| | | |
|---|---|---|
| JP | 9-50167 A | 2/1997 |
| JP | 2007-121719 A | 5/2007 |
| JP | 2013-225146 A | 10/2013 |

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

When executing a job which is a series operations for forming images on a single or a plurality of transfer materials and outputting the transfer material(s), started by a start instruction, a control device switches a polarity of a voltage applied by a first transfer power source in response to a switching of a polarity of a voltage applied by a charging power source, and switches a voltage applied by a second transfer power source from a first voltage to a second voltage which is larger in absolute value than the first voltage.

11 Claims, 6 Drawing Sheets

IMAGE FORMING APPARATUS

BACKGROUND OF THE INVENTION

Field of the Invention

The present disclosure relates to an image forming apparatus, such as a copying machine, a printer, and a facsimile, employing an electrophotographic process or an electrostatic recording process.

Description of the Related Art

A conventional electrophotographic image forming apparatus, for example, is known to employ an intermediate transfer process in which a toner image formed on a photosensitive member as an image bearing member is primarily transferred to an intermediate transfer member and then secondarily transferred onto a transfer material such as paper. In particular, a color image forming apparatus is known as an in-line type image forming apparatus in which a plurality of photosensitive members is disposed along a moving direction of an intermediate transfer member, and toner images of different colors formed on respective photosensitive members are superimposed on the intermediate transfer member.

An intermediate transfer type image forming apparatus uses a known method including charging residual toner remaining on an intermediate transfer member without being transferred onto a transfer material to the polarity opposite to the toner's normal charging polarity via a charging unit, transferring the residual toner from the intermediate transfer member to a photosensitive member simultaneously with the primary transfer, and collecting the residual toner (Japanese Patent Application Laid-Open No. 9-50167). The residual toner transferred to the photosensitive member is collected by a photosensitive member cleaning unit for cleaning the photosensitive member.

However, in the above-described conventional method, since the residual toner on the intermediate transfer member is charged to the polarity opposite to the toner's normal charging polarity by the charging unit, the electrostatic adsorption force between the residual toner and the photosensitive member acts more strongly than that in a case where the residual toner is charged to the toner's normal charging polarity. This may possibly degrade the capability of cleaning the photosensitive member.

On the other hand, although the cleaning capability of the photosensitive member cleaning unit may be improved, improving the cleaning capability may shorten the lifetime of the photosensitive member. For example, a cleaning blade (rubber blade) as a cleaning member disposed in contact with the photosensitive member is used as a photosensitive member cleaning unit in many cases. To improve the cleaning capability of the cleaning blade, the inroad amount and contact pressure of the cleaning blade on the photosensitive member may be increased. In this case, however, the friction between the photosensitive member and the cleaning blade increases the amount of scraping of the photosensitive member and the cleaning blade, possibly shortening the lifetime of the photosensitive member and the cleaning blade.

In an in-line type image forming apparatus, the polarity to which the residual toner on the intermediate transfer member is charged may be switched from the positive to the negative polarity by the charging unit in synchronization with the timing of completion of the primary transfer at the primary transfer portion on the most upstream side in the moving direction of the intermediate transfer member. The residual toner on the intermediate transfer member charged to the negative polarity can be transferred to the photosensitive member on the most upstream side by applying a negative voltage (having the polarity opposite to the polarity at the time of the primary transfer) to a primary transfer member provided at the primary transfer portion on the most upstream side.

However, at this timing, toner images are still being primarily transferred at the primary transfer portion on the downstream side of the primary transfer portion on the most upstream side. Thus, a transfer current supplied to the primary transfer portion on the downstream side may transmit along the intermediate transfer member and leak to the primary transfer portion on the most upstream side, possibly causing a transfer failure at the primary transfer portion on the downstream side.

SUMMARY OF THE INVENTION

The present disclosure is directed to an image forming apparatus capable of suppressing the occurrence of a transfer failure at a primary transfer portion on the downstream side when toner is collected to an image bearing member by applying a voltage (having the polarity identical to the toner's normal charging polarity) to a primary transfer member at a primary transfer portion on the upstream side.

Further features of the present disclosure will become apparent from the following description of exemplary embodiments with reference to the attached drawings.

DESCRIPTION OF THE EMBODIMENTS

An image forming apparatus according to the present disclosure will be described in more detail below with reference to the accompanying drawings.

1. Overall Configurations and Operations of Image Forming Apparatus

Figure 1:
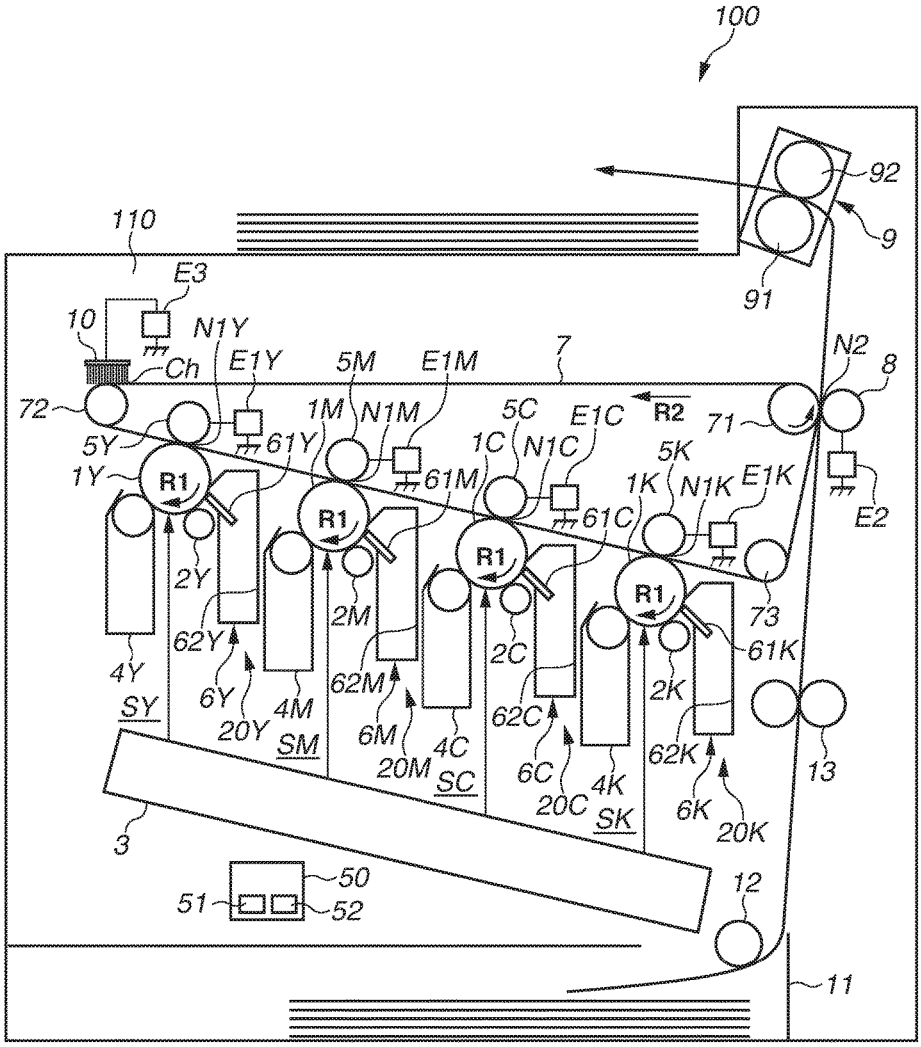
FIG. 1 is a longitudinal sectional view schematically illustrating an image forming apparatus according to a first exemplary embodiment.

FIG. 1 is a sectional view schematically illustrating an image forming apparatus 100 according to a first exemplary embodiment. The image forming apparatus 100 according to the present exemplary embodiment is an in-line type color printer employing an intermediate transfer process, capable of forming a full color image through an electrophotographic process.

The image forming apparatus 100 includes a plurality of image forming units: a first image forming unit SY for forming a yellow (Y) image, a second image forming unit SM for forming a magenta (M) image, a third image forming unit SC for forming a cyan (C) image, and a fourth image forming unit SK for forming a black (K) image. Elements having an identical or corresponding function or configuration in the image forming units SY, SM, SC, and SK may be comprehensively described below. In this case, trailing letters "Y", "M", "C", and "K" reference numerals indicating respective colors may be omitted. According to the present exemplary embodiment, an image forming unit S includes a photosensitive member 1, a charging roller 2, an exposure device 3, a developing device 4, a primary transfer roller 5, and a photosensitive member cleaning device c (described below).

The image forming apparatus 100 includes four photosensitive members (photoconductive drums) 1 disposed along the moving direction of an intermediate transfer belt 7 (described below) as a plurality of image bearing members for bearing toner images. Referring to FIG. 1, the photosensitive member 1 is rotatably driven in the direction of the arrow R1 (clockwise rotation). The surface of the rotating photosensitive member 1 is uniformly charged to a predetermined potential having a predetermined polarity (negative polarity according to the present exemplary embodiment) by the charging roller 2 as a photosensitive member charging unit. The surface of the charged photosensitive member 1 is subjected to scanning exposure according to image information by the exposure device (laser scanner) 3 as an exposure unit. Then, an electrostatic latent image (electrostatic image) is formed on the photosensitive member 1. According to the present exemplary embodiment, the exposure device 3 is configured as a unit for exposing each photosensitive member 1 of each image forming unit S to light.

The electrostatic latent image formed on the photosensitive member 1 is developed (visualized) by using toner as a developer by the developing device 4 as a developing unit, and a toner image is formed on the photosensitive member 1. According to the present exemplary embodiment, toner charged to the polarity identical to the charging polarity of the photosensitive member 1 (negative polarity according to the present exemplary embodiment) adheres to exposure portions on the photosensitive member 1 where the absolute value of the potential is lowered after the uniformly charged photosensitive member 1 is exposed to light.

The intermediate transfer belt 7, formed of an endless belt as a movable intermediate transfer member, is disposed to face the four photosensitive members 1. The intermediate transfer belt 7 is stretched with a predetermined tension by a plurality of stretching rollers including a drive roller 71, a tension roller 72, and an idler roller 73. The primary transfer roller 5, formed of a roller type primary transfer member as a primary transfer device, is disposed on the inner circumferential surface side of the intermediate transfer belt 7 to face each photosensitive member 1. The primary transfer roller 5 is pressed onto the photosensitive member 1 via the intermediate transfer belt 7 to form a primary transfer portion (primary transfer nip) N1 at which the photosensitive member 1 and the intermediate transfer belt 7 contact with each other.

At the primary transfer portion N1, the toner image formed on the photosensitive member 1 as described above is electrostatically transferred (primarily transferred) to the intermediate transfer belt 7 rotating in the direction of the arrow R2 (counterclockwise direction). In the primary transfer process, the primary transfer roller 5 is applied with a primary transfer voltage (primary transfer bias) as a direct current (DC) voltage having the polarity opposite to the charging polarity of toner at the time of development (normal charging polarity) from a primary transfer power source (high-voltage power supply circuit) E1. For example, when forming a full color image, a yellow, a magenta, a cyan, and a black toner images formed on the respective photosensitive members 1 are sequentially transferred to the intermediate transfer belt 7 so as to be superimposed thereon.

The secondary transfer roller 8, formed of roller type secondary transfer member as secondary transfer unit, is disposed on the outer circumferential surface side of the intermediate transfer belt 7 at a position facing the drive roller 71 which also serves as a secondary transfer counter roller. The secondary transfer roller 3 is pressed onto the drive roller 71 via the intermediate transfer belt 7 to form a secondary transfer portion (secondary transfer nip) N2 at which the intermediate transfer belt 7 and the secondary transfer roller 8 contact with each other.

At the secondary transfer portion N2, the toner image formed on the intermediate transfer belt 7 as described above is electrostatically transferred (secondarily transferred) onto a transfer material (recording medium or sheet) P such as paper being sandwiched and conveyed by the intermediate transfer belt 7 and the secondary transfer roller 8. In the secondary transfer process, the secondary transfer roller 8 is applied with a secondary transfer voltage (secondary transfer bias) as a DC voltage having the polarity opposite to the toner's normal charging polarity from a secondary transfer power source (high-voltage power supply circuit) E2. The transfer materials P stored in a cassette 11 are separately fed one by one by a feed roller 12 and then conveyed to a conveyance roller pair 13. Then, the transfer material P is supplied to the secondary transfer portion N2 by the conveyance roller pair 13 in synchronization with the toner image on the intermediate transfer belt 7.

The transfer material P with the toner image transferred thereonto is conveyed to a fixing device 9 as a fixing unit. The fixing device 9 includes a heat roller 91 as a heating member having a heat source, and a pressurizing roller 92 as a pressing member in pressure contact with the heat roller 91*a* When the transfer material P is heated and pressurized by the heat roller 91 and the pressurizing roller 92, respectively, the toner image is melted and fixed onto the surface of the transfer material P. Then, the transfer material P is discharged (output) out of an apparatus main body 110 of the image forming apparatus 100.

On the other hand, the residual toner remaining on the photosensitive member 1 after the primary transfer process is removed and collected from the surface of the photosensitive member 1 by the photosensitive member cleaning device 6 as a photosensitive member cleaning unit. Cleaning of the residual toner remaining on the intermediate transfer belt 7 after the secondary transfer process will be described below.

According to the present exemplary embodiment, the photosensitive member 1 and a process unit (the charging roller 2, the developing device 4, and the photosensitive member cleaning device 6) acting on the photosensitive member 1 are integrally formed as a cartridge, more specifically, a process cartridge 20 detachably attached to the apparatus main body 110.

According to the present exemplary embodiment, the photosensitive member 1 is formed of an aluminum cylinder having a 30 mm diameter applied with an organic photoconductive layer (OPC photosensitive member) as a photosensitive layer on the outer circumferential surface thereof.

According to the present exemplary embodiment, the charging roller 2 as a conductive roller formed in the shape of a roller is disposed in contact with the surface of the photosensitive member 1. The charging roller 2 is applied with a photosensitive member charging voltage (photosensitive member charging bias) equal to or higher than a negative discharge start voltage from a photosensitive member charging power source (not illustrated) in the photosensitive member charging process.

According to the present exemplary embodiment, the primary transfer roller 5 as a conductive roller formed in the shape of a roller is composed of a shaft having a 6 mm outer diameter made of such a metal as SUS, and a foamable elastic member applied around the shaft to achieve a 12 mm outer diameter. The primary transfer roller 5 has an electrical resistance of 106 to 109 ohms (Ω). According to the present exemplary embodiment, first transfer rollers 5Y, 5M, 5C, and 5K are independently connected with primary transfer power sources E1Y, E1M, E1C, and E1K, respectively, as transfer power sources. According to the present exemplary embodiment, each of the first transfer power sources E1 can selectively apply a voltage having the polarity opposite to the toner's normal charging polarity and a voltage having the polarity identical to the toner's normal charging polarity to each of the primary transfer rollers 5.

According to the present exemplary embodiment, the intermediate transfer belt 7 is formed of a film-like member with a thickness of about 50 to 150 micrometers having a volume resistivity of 107 to 1014 ohm-centimeters (Ωcm) configured in the shape of an endless belt. The above-described volume resistivity was measured by using a measurement probe conforming to JIS Method K6911. In the measurement, a voltage of 50 to 100 V was applied by using the R2340 High Resistance Meter from ADVANTEST at 25° C. temperature and 50% relative humidity.

According to the present exemplary embodiment, the photosensitive member cleaning device 6 includes a cleaning blade 61 as a cleaning member disposed in contact with the photosensitive member 1, and a collection container 62 for collecting the residual toner removed from the surface of the photosensitive member 1 by the cleaning blade 61. The cleaning blade 61 is formed of a plate-like elastic rubber. The photosensitive member cleaning device scratches the residual toner from the surface of the rotating photosensitive member 1 by using the cleaning blade 61 and collects the residual toner in the collection container 62. When the process cartridge 20 is replaced, the residual toner collected by the photosensitive member cleaning device 6 is discarded together with the process cartridge 20 detached from the apparatus main body 110.

According to the present exemplary embodiment, the operation of each component of the image forming apparatus 100 is totally controlled by a control unit 50 as a control device provided in the apparatus main body 110. The control unit 50 includes a central processing unit (CPU) 51 as a calculation control unit, and a storage unit (memory) 52. The CPU 51 controls the operation of each component of the image forming apparatus 100 according to a program stored in the storage unit 52. According to the present exemplary embodiment, in particular, the control unit 50 controls the primary transfer power sources E1Y, E1M, E1C, and E1K and a charging power source E3 (described below) to instruct the photosensitive member cleaning devices 6 to perform an operation for collecting toner on the intermediate transfer belt 7.

In this case, the image forming apparatus 100 executes a job (print operation) as a series of operations for forming and outputting an image on a single or a plurality of transfer materials P started by a start instruction. Generally, a job includes an image forming process, a pre-rotation process, a sheet interval process (when forming an image on a plurality of transfer materials P), and a post-rotation process. The image forming process refers to a time period for forming electrostatic latent images of an image to be actually formed on the transfer material P and output, forming toner images, and primarily and secondarily transfer the toner images. The image forming time refers to this time period. In more detail, the timing of image forming differs for each of positions of the electrostatic latent image forming process, the toner image forming process, and the primary and secondary toner image transfer processes. The pre-rotation process refers to a time period for performing a preparation operation before the image forming process, i.e., the time interval between the time when a start instruction is input till the time when image formation is actually started. The sheet interval process (image interval process) refers to a time period corresponding to an interval between the transfer materials P when the image forming process is continuously performed on a plurality of transfer materials P (continuous image formation). The post-rotation process refers to a time period for performing an arrangement operation (preparation operation) after the image forming process. The non-image forming time period collectively refers to time periods other than the image forming time period. More specifically, the non-image forming time period includes the above-describe pre-rotation process, the sheet interval process, the post-rotation process, and also the multiple pre-rotation process which is a preparation operation when the power of the image forming apparatus 100 is turned ON or when the apparatus returns from the sleep state.

2. Cleaning of Intermediate Transfer Belt

Cleaning of the intermediate transfer belt 7 according to the present exemplary embodiment will be described below. In the following descriptions, the first image forming unit. SY, the second image forming unit SM, the third image forming unit SC, and the fourth image forming unit SK and related elements may be distinguished by leading letters "Y", "M", "C", and "K" supplied to each name, respectively.

The image forming apparatus 100 includes a cleaning brush 10, formed of a brush-like charge member as a charging unit, for charging toner on the intermediate transfer member. The cleaning brush 10 is disposed to charge the toner on the intermediate transfer belt 7 at a charging portion Ch on the downstream side of the secondary transfer portion N2 and on the upstream side of the primary transfer portion N1 (primary transfer portion N1Y on the most upstream side) in the moving direction of the intermediate transfer belt 7 (conveyance direction). According to the present exemplary embodiment, in particular, the cleaning brush 10 is disposed in contact with the surface of the intermediate transfer belt 7 at a position facing the tension roller 72 via the intermediate transfer belt 7. The cleaning brush 10 is connected with a charging power source (high-voltage power supply circuit) E3.

According to the present exemplary embodiment, the residual toner remaining on the intermediate transfer belt 7 without being transferred onto the transfer material P at the secondary transfer portion N2 is charged by the cleaning brush 10 at the charging portion Oh. Then, at the primary transfer portion N1, the residual toner on the intermediate transfer belt 7 is transferred to the photosensitive member 1 and then collected.

According to the present exemplary embodiment, the cleaning brush 10 is formed of conductive nylon fibers, having an electrical resistance of 106 to 109 ohms (G), almost tightly arranged. The cleaning brush 10 has a 4 mm width (in the moving direction of the intermediate transfer belt 7) and a longitudinal length (in the direction approximately perpendicularly intersecting with the moving direction of the intermediate transfer belt 73 which is longer than the width of the area on the intermediate transfer belt 7 over which the toner image can be bored. The cleaning brush 10 is pressed onto the tension roller 72 via the intermediate transfer belt 7 so that the tip position of the brush fibers provides an inroad amount of 1.0 mm on the surface of the intermediate transfer belt 7. The cleaning brush 10 is disposed at a fixed position with respect to the intermediate transfer belt 7, and abrades the surface of the intermediate transfer belt 7 with the movement of the intermediate transfer belt 7.

In this case, the above-described conventional method (the method of charging the residual toner on the intermediate transfer member to the polarity opposite to the toner's normal charging polarity and then transferring the residual toner to the photosensitive member and collecting it) has a problem of difficulty in achieving both the capability of cleaning the photosensitive member and the durability of the photosensitive member and the cleaning blade. Thus, it is desirable that the amount of toner charged to the polarity opposite to the toner's normal charging polarity of toner to be transferred from the intermediate transfer member to the photosensitive member is as small as possible.

Further, the conventional method (the method of charging the residual toner on the intermediate transfer member to the polarity opposite to the toner's normal charging polarity and then transferring the residual toner to the photosensitive member and collecting it) has another problem. More specifically, toner charged to the normal charging polarity without being charged to the polarity opposite to the toner's normal charging polarity may electrostatically adhere to the charge member and gradually accumulate thereon. Thus, to maintain the chargeability of the charge member, the image forming apparatus 100 is known to perform an operation for discharging the toner accumulated on the charge member to the intermediate transfer member in the time period corresponding to the interval between images (sheet interval) in a job. However, when the sheet interval is short, toner may not be sufficiently discharged from the charge member. Extending the sheet interval to sufficiently discharge toner from the charge member will reduce the number of printable sheets per unit time.

On the other hand, according to the present exemplary embodiment, the charging power source E3 can selectively apply a voltage having the polarity opposite to the toner's normal charging polarity and a voltage having the polarity identical to the toner's normal charging polarity to the cleaning brush 10. Then, according to the present exemplary embodiment, the control unit 50 performs control to switch the polarity of the voltage applied to the cleaning brush 10 by the charging power source E3 from the positive to the negative polarity during execution of a job. Then, in association with the switching the polarity of the voltage applied by the charging power source E3 from the positive to the negative polarity, the control unit 50 performs control to switch the polarity of the voltage applied to the primary transfer roller 5 from the positive to the negative polarity. This enables transferring both positively charged toner and negatively charged toner on the intermediate transfer belt 7 to the photosensitive member 1 and then collecting them. "During execution of a job" means a time period since the time when a job is started till the time when the primary transfer is completed for all toner images in the job at all of the primary transfer portions N1.

In particular, according to the present exemplary embodiment, the residual toner on the intermediate transfer belt 7 is transferred to the photosensitive member 1Y at the primary transfer portion N1Y disposed on the most upstream side in the moving direction of the intermediate transfer belt 7 and then collected More specifically, when the residual toner positively charged by the cleaning brush 10 applied with a positive voltage passes through the primary transfer portion N1Y, the primary transfer roller 5Y is applied with a positive voltage. When the residual toner negatively charged by the cleaning brush 10 applied with a negative voltage passes through the primary transfer portion N1Y, the primary transfer roller 5Y is applied with a negative voltage. Further, according to the present exemplary embodiment, switching the polarity of the voltage applied to the cleaning brush 10 from the positive to the negative polarity enables transferring (discharging) the negatively charged toner adhering to the cleaning brush 10 to the intermediate transfer belt 7 during execution of a job. Then, when the primary transfer roller 5Y is applied with a negative voltage, the toner discharged from the cleaning brush 10 to the intermediate transfer belt 7 is also transferred to the photosensitive member 1Y and then collected.

However, as described above, when the polarity of the voltage applied to the primary transfer roller 5Y is switched from the positive to the negative polarity during execution of a job, the primary transfer is still being executed at primary transfer portions N1M, N1C, and N1K at this timing. Thus, transfer currents supplied to the primary transfer portions N1M, N1C, and N1K may transmit along the intermediate transfer belt 7 and leak to the primary transfer portion N1Y, possibly causing a transfer failure at the primary transfer portions N1M, N1C, and N1K. In particular, the transfer current supplied to the primary transfer portion N1M adjacent to the primary transfer portion N1Y easily leaks to the primary transfer portion N1Y.

According to the present exemplary embodiment, the control unit 50 performs control to increase the absolute value of the primary transfer voltage applied to the primary transfer roller 5M in association with the switching of the polarity of the voltage applied to the primary transfer roller 5Y from the positive to the negative polarity.

More specifically, according to the present exemplary embodiment, the control unit 50 performs the following control before the primary transfer is completed for all toner images at the primary transfer portion N1M in a job. Firstly, the control unit 50 switches the polarity of the voltage applied by the charging power source E3 from the positive to the negative polarity. Secondly, the control unit 50 switches the polarity of the voltage applied by the primary transfer power source E1Y from the positive to the negative polarity. Thirdly, the control unit 50 switches the voltage applied by the primary transfer power source E1M from the first voltage (when the primary transfer power source E1Y applies a positive voltage) to the second voltage which is larger in absolute value than the first voltage (when the primary transfer power source E1Y applies a negative voltage).

According to the present exemplary embodiment, the charging power source E3 can apply a voltage (charging bias) of −2.0 to +2.0 kV to the cleaning brush 10. According to the present exemplary embodiment, the voltage applied to the cleaning brush 10 was set to a +1.5 kV positive voltage and a −1.2 kV negative voltage.

According to the present exemplary embodiment, the primary transfer power source E1Y applies a +440 V voltage to the primary transfer roller 5Y during the primary transfer at the primary transfer portion N1Y. The primary transfer power source E1Y applies a −700 V voltage to the primary transfer roller 5Y after completion of the primary transfer at the primary transfer portion N1Y.

According to the present exemplary embodiment, when the primary transfer roller 5Y is applied with a positive voltage, the primary transfer power source E1M applies a +440 V voltage to the primary transfer roller 5M. When the primary transfer roller 5Y is applied with a negative voltage, the primary transfer power source E1M applies to the primary transfer roller 5M a +500 V voltage which is 60 V larger in absolute value than the above-described +440 V voltage.

3. Voltage Application Timing

Figure 2:
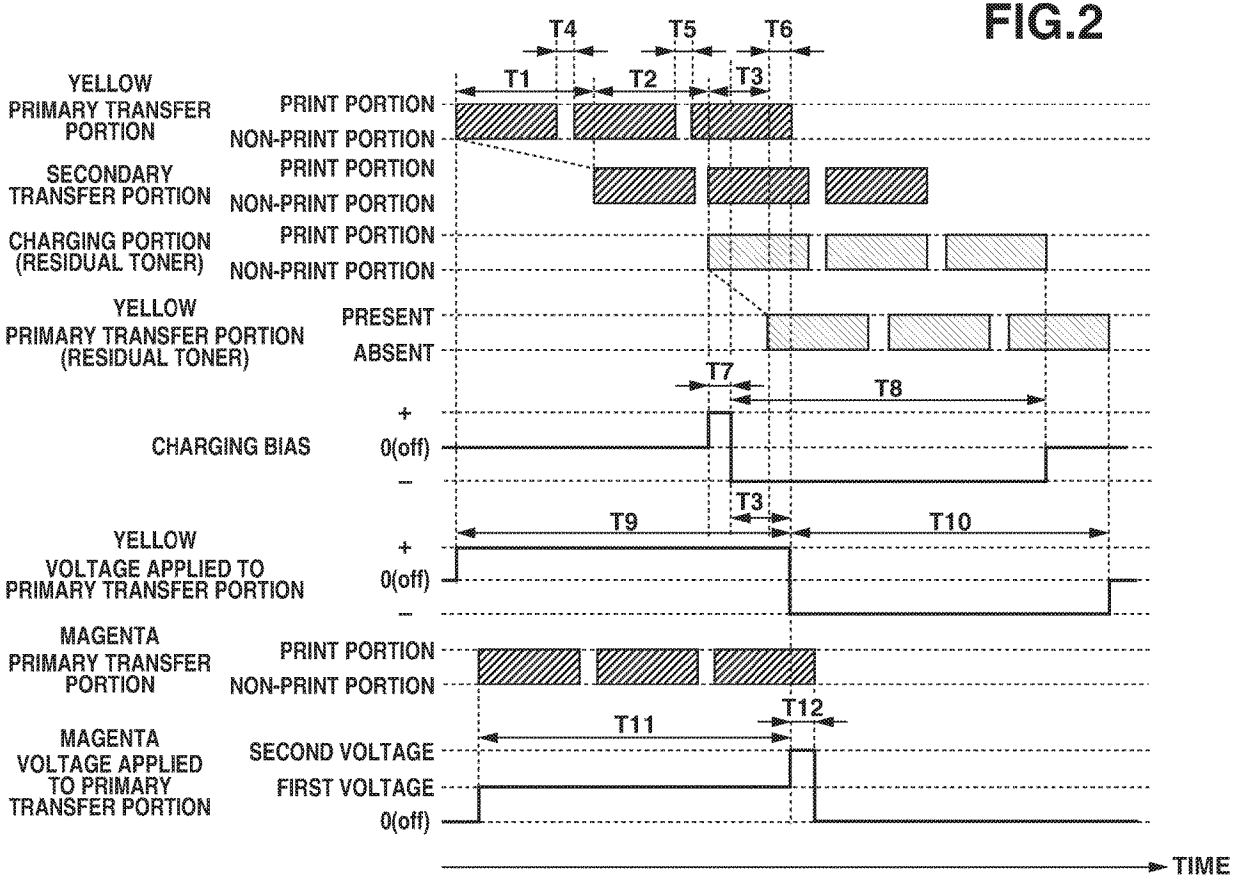
FIG. 2 is a timing chart illustrating control according to the first exemplary embodiment.

The voltage application timing of the charging power source E3, the primary transfer power source E1Y, and the primary transfer power source E1M according to the present exemplary embodiment will be described below. FIG. 2 is a timing chart illustrating the voltage application timing in a job for continuously printing three different full color images. FIG. 2 illustrates three different time periods when the toner image on the photosensitive member 1Y passes through the primary transfer portion N1Y (print portion), and three different time periods when the toner image on the intermediate transfer belt 7 passes through the secondary transfer portion N2 (print portion). FIG. 2 illustrates three different time periods when the residual toner (a position that was a print portion) on the intermediate transfer belt 7 passes through the charging portion Ch, and three different time periods when the residual toner (a position that was a print portion) on the intermediate transfer belt 7 passes through the primary transfer portion N1Y. FIG. 2 illustrates three time periods when the toner image on the photosensitive member 1M passes through the primary transfer portion N1M (print portion).

Referring to FIG. 2, a time period T4 indicates the sheet interval between the first and the second sheets, and a time period T5 indicates the sheet interval between the second and the third sheets. Referring to FIG. 2, a time period T1 is a time period required for the toner image on the intermediate transfer belt 7 to move from the primary transfer portion N1Y to the secondary transfer portion N2. Referring to FIG. 2, a time period T2 is a time period required for the residual toner on the intermediate transfer belt 7 to move from the secondary transfer portion N2 to the charging portion Ch. Referring to FIG. 2, a time period T3 is a time period required for the residual toner on the intermediate transfer belt 7 to move from the charging portion Ch to the primary transfer portion N1Y.

The cleaning brush 10 is applied with a positive voltage during a time period T7 and then applied with a negative voltage during a time period T8. According to the present exemplary embodiment, when the residual toner of the first toner image in a job on the intermediate transfer belt 7 reaches the charging portion Ch, the control unit 50 starts applying a positive charging bias to the cleaning brush 10. The cleaning brush 10 is applied with a positive charging bias during the time period T7 in order to simultaneously perform, during the subsequent time period T6, the primary transfer of the negatively charged toner on the photosensitive member 1Y and the transfer of the positively charged residual toner on the intermediate transfer belt 7 to the photosensitive member 1Y by electrostatic repulsion. The time period T8 is a time period since the time when the polarity of the charging bias is switched to the negative polarity till the time when the residual toner of all toner images in a job on the intermediate transfer belt 7 has passed through the charging portion Ch. During the time period T8, the negatively charged residual toner on the intermediate transfer belt 7 or the negatively charged toner accumulated in the cleaning brush 10 and discharged from the cleaning brush 10 to the intermediate transfer belt 7 is transferred to the photosensitive member 1Y by electrostatic repulsion.

In this case, the timing for switching the polarity of the charging bias from the positive to the negative polarity is obtained by subtracting the above-described time period T3 from the timing when the primary transfer is completed for all toner images in a job at the primary transfer portion N1Y. The time period T3 is a time period required for the residual toner on the intermediate transfer belt 7 to move from the charging portion Ch to the primary transfer portion N1Y. More specifically, the control unit 50 performs control to switch the polarity of the voltage applied by the primary transfer power source E1Y from the positive to the negative polarity at the following timing. This timing means a timing before the position on the intermediate transfer belt 7 having passed the charging portion Ch after switching the polarity of the voltage applied by the charging power source E3 from the positive to the negative polarity reaches the primary transfer portion N1Y. According to the present exemplary embodiment, the control unit 50 performs control to switch the polarity of the voltage applied by the primary transfer power source E1Y from the positive to the negative polarity after the primary transfer is completed for all toner images in the job at the primary transfer portion N1Y. In particular, according to the present exemplary embodiment, the control unit 50 performs control so that the position on the intermediate transfer belt 7 having passed the charging portion Ch when the polarity of the charging bias is switched reaches the primary transfer portion N1Y almost simultaneously with the time when the primary transfer is completed for all toner images in the job at the primary transfer portion N1Y. This enables reducing the amount of positively charged toner to be transferred to the photosensitive member 1Y as much as possible.

The primary transfer roller 5Y is applied with a positive voltage during a time period T9 since the time when the primary transfer of the first toner image in the job at the primary transfer portion N1Y is started till the time when the primary transfer of the last toner image is completed. During a time period T10, the primary transfer roller 5Y is applied with a negative voltage. The time period T10 is a time period since the time when the polarity of the voltage applied to the primary transfer roller 5Y is switched to the negative polarity till the time when the residual toner of all toner images in the job on the intermediate transfer belt 7 passes through the primary transfer portion N1Y.

The primary transfer roller 5M is applied with the positive first voltage (+440 V) during a time period T11 since the time when the primary transfer of the first toner image in the job at the primary transfer portion N1M is started. According to the present exemplary embodiment, the voltage applied to the primary transfer roller 5M is switched from the first to the second voltage (+500 V) in association with the switching of the polarity of the voltage applied to the primary transfer roller 5Y from the positive to the negative polarity, more specifically, almost simultaneously with this switching. The second voltage is 60 V larger in absolute value than the first voltage. Then, the primary transfer roller 5M is applied with the second voltage during a time period T12 till the time when the primary transfer of the last toner image in the job at the primary transfer portion N1M is completed.

With the above-described voltage application timing, substantially all of the residual toner on the intermediate transfer belt 7 or the toner discharged from the cleaning brush 10 are transferred to the photosensitive member 11 and then collected.

4. Comparative Example

Figure 3:
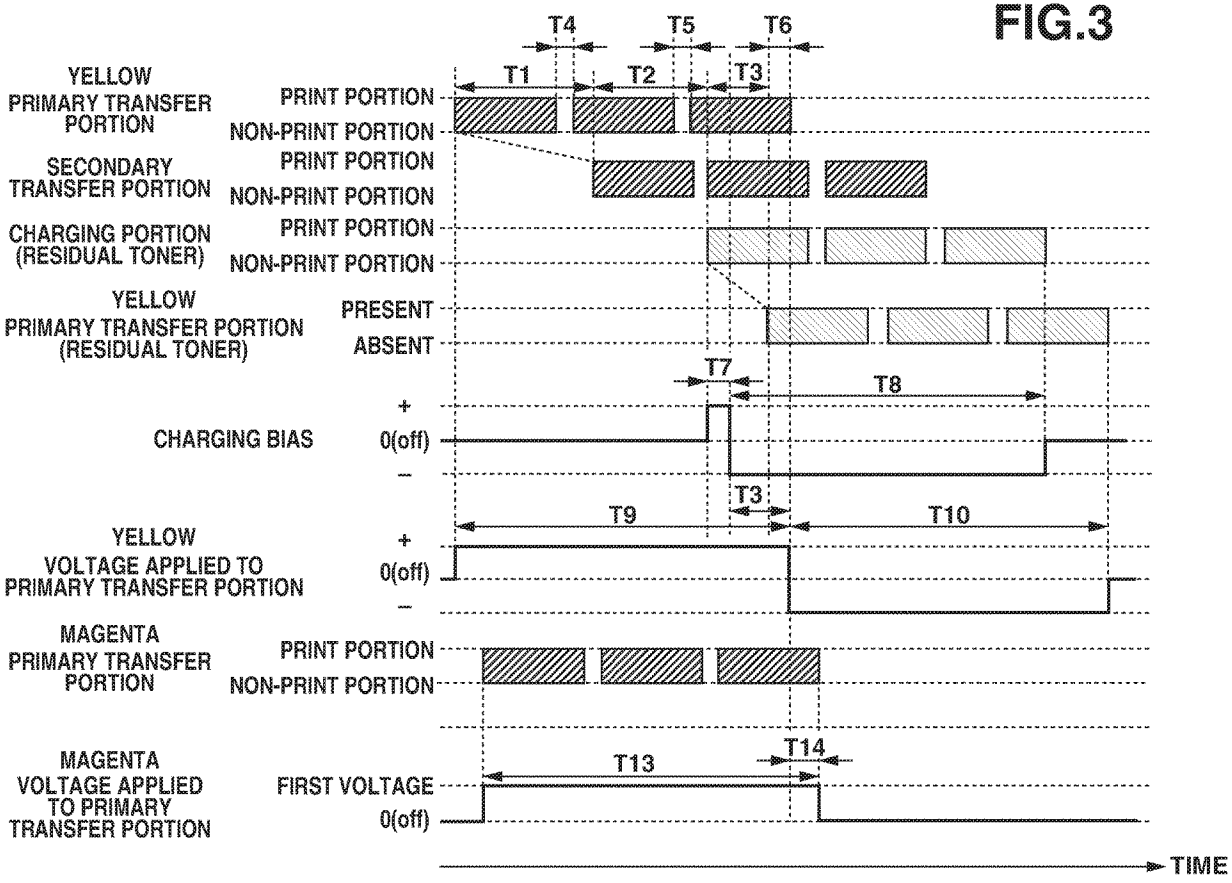
FIG. 3 is a timing chart illustrating control according to a comparative example.

FIG. 3 is a timing chart according to a comparative example, which is similar to the timing chart illustrated in FIG. 2 according to the present exemplary embodiment.

According to the comparative example, the voltage applied to the primary transfer roller 5M was fixed to +440 V during a time period T13 since the time when the primary transfer of the first toner image in the job at the primary transfer portion N1M is started till the time when the primary transfer of the last toner image is completed. This voltage corresponds to the first voltage according to the present exemplary embodiment.

Except for the above-described points, the image forming apparatus 100 according to the comparative example is substantially similar to the image forming apparatus 100 according to the present exemplary embodiment.

5. Confirmation of Effects

The image forming apparatuses 100 according to the present exemplary embodiment and the comparative example printed three halftone full page images and confirmed the presence of a transfer failure under environmental conditions of 30° C. temperature and 80% relative humidity. As a result, a transfer failure did not occur in the present exemplary embodiment. However, according to the comparative example, a transfer failure (void magenta image) occurred in a time period T14 illustrated in FIG. 3 corresponding to the trailing edge of the transfer material P of the third sheet.

According to the comparative example, even after the voltage applied to the primary transfer roller 51 was switched from +440 V to −700 V, the voltage applied to the primary transfer roller 5M was maintained to +440 V. Thus, a transfer failure is assumed to have occurred in the following way. After switching the polarity of the voltage applied to the primary transfer roller 51, the transfer current transmitted from the primary transfer portion N1M to the surface of the intermediate transfer belt 7 and leaked to the primary transfer portion N1Y. Then, the field intensity required for the primary transfer weakened, resulting in a transfer failure.

According to the present exemplary embodiment, on the other hand, the voltage applied to the primary transfer roller 5M was switched from +440 V to +500 V in synchronization with the timing of the switching of the voltage applied to the primary transfer roller 51 from +440 V to −700 V. Thus, a transfer failure is assumed to have been suppressed since a stable field intensity was obtained at the primary transfer portion N1M.

As described above, in the present exemplary embodiment, the residual toner on the intermediate transfer belt 7 is charged to the polarity identical to the toner's normal charging polarity as much as possible. This decreases the electrostatic adsorption force between the residual toner and the photosensitive member 1 when the residual toner is transferred to the photosensitive member 1, making it possible to lower the contact pressure and the inroad amount of the cleaning blade 61 on the photosensitive member 1. As a result, it becomes possible to achieve both the capability of cleaning the photosensitive member 1 and the durability of the photosensitive member 1 and the cleaning blade 61. According to the present exemplary embodiment, toner can be sufficiently discharged from the cleaning brush 10 not during the short sheet interval but during the secondary transfer having flexibility in switching the timing of the primary transfer bias. This recovers the chargeability of the cleaning brush 10 making it possible to suppress the degradation of the capability of cleaning the intermediate transfer belt 7 over a prolonged period of time. According to the present exemplary embodiment, a transfer failure at the primary transfer portion N1M can be suppressed by increasing the absolute value of the voltage applied to the primary transfer roller 5M in association with the switching of the voltage applied to the primary transfer roller 5Y from the positive to the negative polarity.

According to the present exemplary embodiment, the control unit 50 switched the primary transfer voltage applied to the primary transfer roller 5M provided for the primary transfer portion N1M adjacent to the primary transfer portion N1Y. Likewise, the primary transfer voltages applied to the primary transfer rollers 5C and 5K can also be switched to increase the absolute value in association with the switching of the polarity of the voltage applied to the primary transfer roller 5Y. Thus, similar to the primary transfer portion N1M, the effect of suppressing a transfer failure can also be obtained at the primary transfer portions N1C and N1K. However, if a transfer failure does not occur or occurs within a permissible range at the primary transfer portion N1 on the downstream side of the primary transfer portion N1M adjacent to the primary transfer portion N1Y, it is not necessary to switch the primary transfer voltage at the primary transfer portion N1. Further, depending on the degree of a transfer failure, (all or a part of) the values of the second voltages may be differentiated at the primary transfer portions N1M, N1C, and N1K. For example, the absolute values of the second voltages applied to the primary transfer rollers 5M, 5C, and 5K may be decreased in this order.

Although, in the present exemplary embodiment, the second voltage is 60 V larger in absolute value than the first voltage, the second voltage is not limited thereto. The voltages may be suitably set depending on the configuration of the image forming apparatus 100 and the absolute value of the negative voltage applied to the primary transfer roller 5Y. The control unit 50 can change the second voltage according to the absolute value of the negative voltage applied by the primary transfer power source E1Y. In this case, typically, the control unit 50 changes the second voltage so that the absolute value of the second voltage in the case of a second absolute value (larger than a first absolute value) of the negative voltage applied by the primary transfer power source E1Y becomes larger than the absolute value of the second voltage in the case of the first absolute value of the negative voltage.

According to the present exemplary embodiment, the voltage applied to the primary transfer roller 5M is switched from the first to the second voltage almost simultaneously with the switching of the polarity of the voltage applied to the primary transfer roller 5Y from the positive to the negative polarity. However, for example, the timing of the switching from the first to the second voltage may be changed as follows. More specifically, a time period for preparation of about 200 milliseconds, for example, is required to switch the polarity of the voltage applied to the primary transfer roller 5Y from the positive to the negative polarity. Thus, even during this time period for preparation, a transfer current at the primary transfer portion N1M may transmit along the intermediate transfer belt 7 and possibly leak to the primary transfer portion N1Y. Accordingly, the timing of the switching the voltage applied to the primary transfer roller 5M from the first to the second voltage can be brought forward before the timing when the polarity of the voltage applied to the primary transfer roller 5Y changes to the negative polarity by about 200 milliseconds. Thus, typically, the control unit 50 completes the switching of the voltage applied by the primary transfer power source E1M from the first to the second voltage during a time period since the time when the switching of the polarity of the voltage applied by the primary transfer power source E1Y from the positive to the negative polarity is started till the time when the switching is completed. The control unit 50 in this case can start switching the voltage applied by the primary transfer power source E1M from the first to the second voltage at a predetermined time before the control unit 50 starts switching the polarity of the voltage applied by the primary transfer power source E1Y from the positive to the negative polarity.

A second exemplary embodiment of the present disclosure will be described below. The basic configurations and operations of the image forming apparatus according to the present exemplary embodiment are similar to those according to the first exemplary embodiment. In the present exemplary embodiment, elements having functions or configurations identical to or corresponding to those according to the first exemplary embodiment may be assigned the same reference numerals as those in the first exemplary embodiment, and detailed descriptions thereof will be omitted.

According to the present exemplary embodiment, the value of the second voltage applied to the primary transfer roller 5M is changed according to information correlated with the use amount of the photosensitive member 1.

More specifically, the film thickness of the photosensitive layer on the photosensitive member 1 is reduced, for example, by the friction with the cleaning lade 61 depending on the number of printed sheets in printing performed by using the photosensitive member 1. The value of the suitable primary transfer voltage may change with the change in the film thickness. A relatively thick film makes the transfer current relatively difficult to flow, and a relatively thin film makes the transfer current relatively easy to flow. Thus, it is desirable to change the primary transfer voltage to a suitable value according to the film thickness of the photosensitive member 1.

The film thickness of the photosensitive member 1 has correlations with the use amount of the photosensitive member 1, i.e., the accumulated values of the rotation time, the number of rotations, the time period during which charging processing was performed, and the number of rotations during execution of charging processing. According to the present exemplary embodiment, the control unit 50 successively updates the accumulated value of the rotation time (accumulated rotation time) since the use (unused state) of the photosensitive member 1 was started, and stores the value in the storage unit 52 as information about the use amount of the photosensitive member 1. According to the present exemplary embodiment, the control unit 50 performs control to determine the value of the second voltage applied to the primary transfer roller 5M according to the accumulated rotation time of the photosensitive member 1.

Table 1 illustrates the relation between the accumulated rotation time of the photosensitive member 1, the lifetime of the photosensitive member 1, the value of the second voltage applied to the primary transfer roller 5M. The lifetime of the photosensitive member 1 is set as follows. Print conditions includes the 4-sheet intermittent mode, 65,000 printed sheets, and the 0% remaining lifetime of the photosensitive member 1. For example, an accumulated rotation time of 11.9 hours of the photosensitive member 1 is equivalent to 21,600 printed sheets and the 68% remaining lifetime of the photosensitive member 1. Further, an accumulated rotation time of 33.8 hours of the photosensitive member 1 is equivalent to 43,400 printed sheets and the 34% remaining lifetime of the photosensitive member 1. Further, an accumulated rotation time of 35.8 hours of the photosensitive member 1 is equivalent to 65,000 printed sheets and the 0% remaining lifetime of the photosensitive member 1. As illustrated in Table 1, when the accumulated rotation time of the photosensitive member 1M is relatively large, it is desirable to relatively decrease the absolute value of the second voltage applied to the primary transfer roller 5M. More specifically, the control unit 50 acquires information correlated with the use amount of the photosensitive member 1M and changes the second voltage based on the information correlated with the use amount. In this case, typically, the control unit 50 changes the second voltage so that the absolute value of the second voltage in the case of a second use amount (larger than a first use amount) becomes smaller than the absolute value of the second voltage in the case of the first use amount.

TABLE 1

| Accumulated rotation time of Photosensitive member | Lifetime of Photosensitive member | Second voltage |
|---|---|---|
| 0 to 11.9 hours | 100 to 68% | +700 V |
| Up to 23.8 hours | 67 to 34% | +600 V |
| Up to 35.8 hours | 33 to 0% | +500 V |

The information indicating the relation in Table 1 is preset and stored in the storage unit 52. When applying the second voltage to the primary transfer roller 5M, the control unit 50 determines the value of the second voltage according to the information about the accumulated rotation time of the photosensitive member 1M at that timing, based on the information indicating the relation illustrated in Table 1. For example, the control unit 50 determines the second voltage as +700 V when the accumulated rotation time of the photosensitive member 1M is 10 hours or as +600 V when the accumulated rotation time of the photosensitive member 1M is 20 hours.

As described above, according to the present exemplary embodiment, the primary transfer voltage applied to the primary transfer roller 5M can be changed to a more suitable value according to the film thickness of the photosensitive member 1M.

When switching the primary transfer voltage applied to the primary transfer rollers 5C and 5K, the value of the second voltage can also be similarly changed according to the information correlated with the use amounts of the photosensitive members 10 and 1K.

A third exemplary embodiment of the present disclosure will be described below. The basic configurations and operations of the image forming apparatus according to the present exemplary embodiment are similar to those according to the first exemplary embodiment. In the present exemplary embodiment, elements having functions or configurations identical to or corresponding to those according to the first exemplary embodiment may be assigned the same reference numerals as those in the first exemplary embodiment, and detailed descriptions thereof will be omitted.

According to the present exemplary embodiment, the value of the second voltage applied to the primary transfer roller 5M is changed according to information about the atmospheric environment where the image forming apparatus 100 is installed.

More specifically, the atmospheric environment such as the temperature and humidity depends on the location where the image forming apparatus 100 is installed. With a relatively small amount of moisture, the electrical resistance values of the primary transfer roller 5M and the intermediate transfer belt 7 are relatively high, and a current does not relatively easily flow. On the other hand, with a relatively large amount of moisture, the electrical resistance values of the primary transfer roller 5M and the intermediate transfer belt 7 are relatively low, and a current relatively easily flows if the primary transfer voltage is not suitably set according to the electrical resistance values of the primary transfer roller 5M and the intermediate transfer belt 7, the toner image transfer becomes unstable possibly causing a transfer failure such as reduced density and uneven density in an output image. Thus, it is desirable to change the primary transfer voltage to a suitable value according to the atmospheric environment. Further, with a relatively large amount of moisture, the electrical resistance of the intermediate transfer belt 7 is relatively low, and a transfer current may easily leak from the primary transfer portion N1M to the primary transfer portion N1Y. Thus, it is also desirable to change the width of the switching of the primary transfer voltage applied to the primary transfer roller 5M from the first to the second voltage according to atmospheric environment.

Figure 5A:
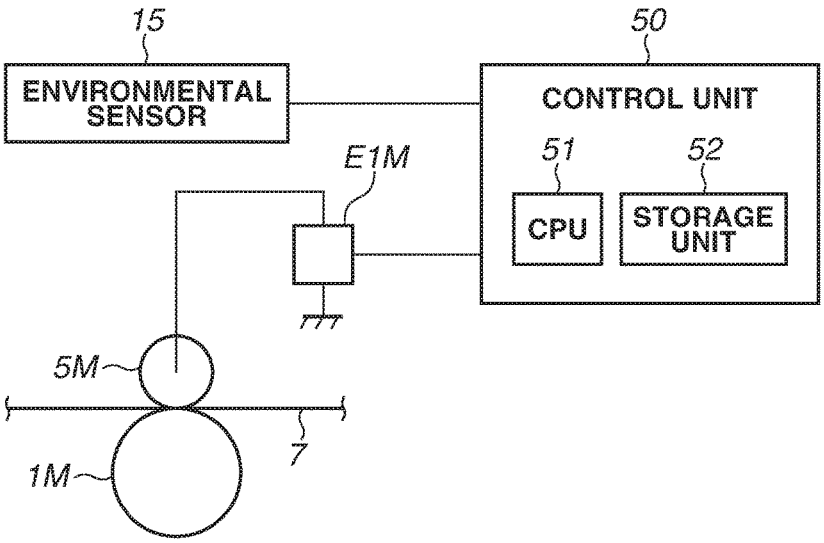
FIGS. 5A and 5B are block diagrams schematically illustrating control modes according to a third and a fourth exemplary embodiments.

According to the present exemplary embodiment, as illustrated in FIG. 5A, the image forming apparatus 100 includes an environmental sensor 15 for detecting the external temperature and humidity of the apparatus main body 110 as an environmental detection unit for detecting at least either one of the temperature and the humidity of at least either one of the inside and the outside of the apparatus main body 110. The control unit 50 can acquire information about the temperature and humidity measured by the environmental sensor 15. Then, according to the measurement result, the control unit 50 performs control to determine the value of the negative primary transfer voltage applied to the primary transfer roller 5Y, and the value of the second voltage applied to the primary transfer roller 5M.

Figure 4:
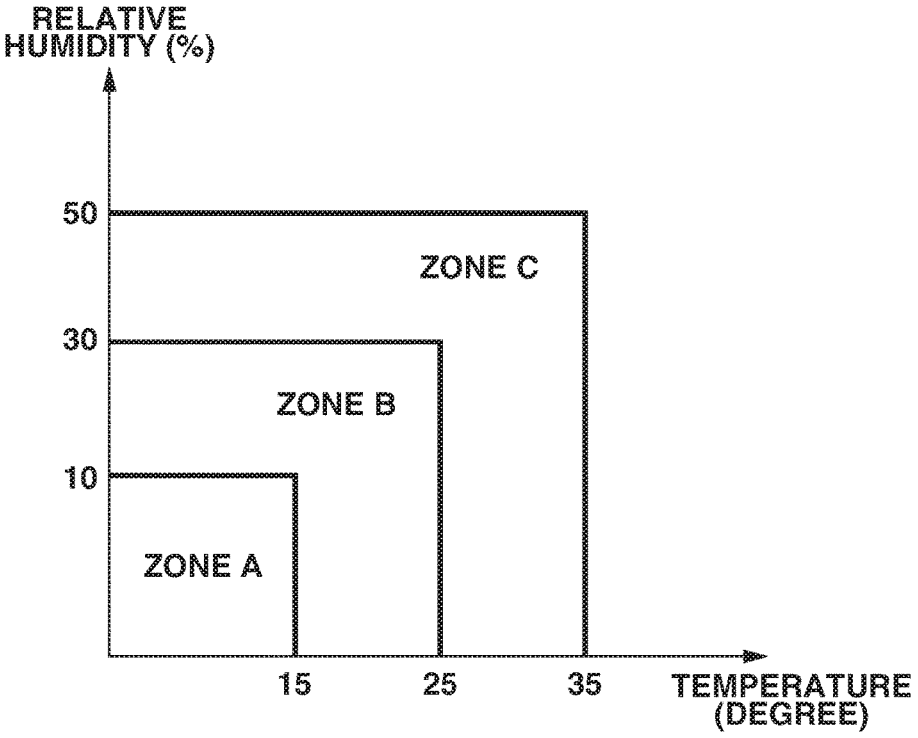
FIG. 4 is a graph illustrating zone definitions in an atmospheric environment according to a third exemplary embodiment.

FIG. 4 is graph illustrating the relation between the temperature, relative humidity, and zone definitions. According to the present exemplary embodiment, when the temperature is 15° C. or less and the humidity is 10% or less, zone A is assumed. When the temperature is higher than 15° C. and equal to or lower than 25° C., and the humidity is higher than 10% and equal to or lower than 30%, zone B is assumed. When the temperature is higher than 25° C. and equal to or lower than 35° C., and the humidity is higher than 30% and equal to or lower than 50%, zone C is assumed. For example, when the temperature is 10° C. and the humidity is 5%, zone A is assumed. When the temperature is 20° C. and the humidity is 20%, zone B is assumed. When the temperature is 30° C. and the humidity is 40%, zone C is assumed.

Table 2 illustrates the relation between the zones and the values of the negative primary transfer voltage applied to the primary transfer roller 5Y. As illustrated in Table 2, when the temperature is relatively high, it is desirable to relatively increase the absolute value of the primary transfer voltage applied to the primary transfer roller 5Y. Also as illustrated in Table 2, when the humidity is relatively high, it is desirable to relatively increase the absolute value the primary transfer voltage applied to the primary transfer roller 5Y.

TABLE 2

| | Negative voltage at Y primary transfer portion |
|---|---|
| Zone A | −700 V |
| Zone B | −1.0 kV |
| Zone C | −1.3 kV |

Table 3 illustrates the relation between zones and the value of the second voltage applied to the primary transfer roller 5M according to the accumulated rotation time of the photosensitive member IN. According to the present exemplary embodiment, the value of the first voltage applied to the primary transfer roller 5M is fixed to +400 V. As illustrated in Table 3, when the temperature is relatively high, it is desirable to relatively increase the absolute value of the second voltage applied to the primary transfer roller 5M. Also as illustrated in Table 3, when the humidity is relatively high, it is desirable to relatively increase the absolute value of the second voltage applied to the primary transfer roller 5M. More specifically, the control unit 50 acquires information about the atmospheric environment and changes the second voltage based on the information about the atmospheric environment. In this case, typically, the control unit 50 changes the second voltage so that at least either one of the following conditions is satisfied. Firstly, the absolute value of the second voltage in the case a second temperature (higher than a first temperature) of the atmospheric environment becomes higher than the absolute value of the second voltage in the case of the first temperature of the atmospheric environment. Secondly, the absolute value of the second voltage in the case a second humidity (higher than a first humidity) of the atmospheric environment becomes higher than the absolute value of the second voltage in the case of the first humidity of the atmospheric environment.

TABLE 3

| | Second voltage | | |
|---|---|---|---|
| | Accumulated rotation time of photosensitive member 0 to 11.9 hours | Accumulated rotation time of photosensitive member Up to 23.8 hours | Accumulated rotation time of photosensitive member Up to 35.8 hours |
| Zone A | +500 V | +470 V | +440 V |
| Zone B | +600 V | +570 V | +540 V |
| Zone C | +700 V | +670 V | +640 V |

The information indicating the relations illustrated in Tables 2 and 3 is preset and stored in the storage unit 52. When applying the negative voltage to the primary transfer roller 5Y, the control unit 50 determines the value of the voltage according to the information about the temperature and relative humidity of the atmospheric environment at that timing, based on the information indicating the relation illustrated in Table 2. When applying the second voltage to the primary transfer roller 5M, the control unit 50 determines the value of the second voltage according to the information about the temperature and relative humidity of the atmospheric environment and the accumulated rotation time of the photosensitive member 1M at that timing, based on the information indicating the relation illustrated in Table 3. For example, when the atmospheric environment is in zone A and the accumulated rotation time of the photosensitive member 1M is 10 hours, the control unit 50 determines the value of the second voltage as +500 V.

As described above, according to the present exemplary embodiment, the primary transfer voltage applied to the primary transfer roller 5M can be changed to a more suitable value according to the atmospheric environment and further to the accumulated rotation time of the photosensitive member 1M.

When switching the primary transfer voltages applied to the primary transfer rollers 5C and 5K, the value of the second voltage can also be similarly changed according to the information about the atmospheric environment and further to the information correlated with the use amounts of the photosensitive members 1C and 1K.

Although, in the present exemplary embodiment, the value of the second voltage is changed according to the information correlated with the use amount of the photosensitive member 1 in addition to the information about the atmospheric environment, the value of the second voltage can be changed only according to the atmospheric environment.

A fourth exemplary embodiment of the present disclosure will be described below. The basic configurations and operations of the image forming apparatus according to the present exemplary embodiment are similar to those according to the first exemplary embodiment. In the present exemplary embodiment, elements having functions or configurations identical to or corresponding to those according to the first exemplary embodiment may be assigned the same reference numerals as those in the first exemplary embodiment, and detailed descriptions thereof will be omitted.

According to the present exemplary embodiment, the control unit 50 changes the value of the second voltage applied to the primary transfer roller 5M according to the information correlated with the electrical resistance of the intermediate transfer belt 7.

More specifically, the electrical resistances of the intermediate transfer belt 7 and the primary transfer roller 5 change with the manufacturing tolerances, the number of printed sheets, and the atmospheric environment. Then, if the primary transfer voltage is not suitably set according to the electrical resistance values of the intermediate transfer belt 7 and the primary transfer roller 5, the toner image transfer becomes unstable possibly causing a transfer failure such as reduced density and uneven density in an output image. Thus, it is desirable to change the primary transfer voltage to a suitable value according to the electrical resistances of the intermediate transfer belt 7 and the primary transfer roller 5. Further, as described above, with a relatively low electrical resistance of the intermediate transfer belt 7, a transfer current may easily leak from the primary transfer portion N1M to the primary transfer portion N1Y. In this case, it is also desirable to change the width of the switching from the first to the second voltage.

Figure 5B:
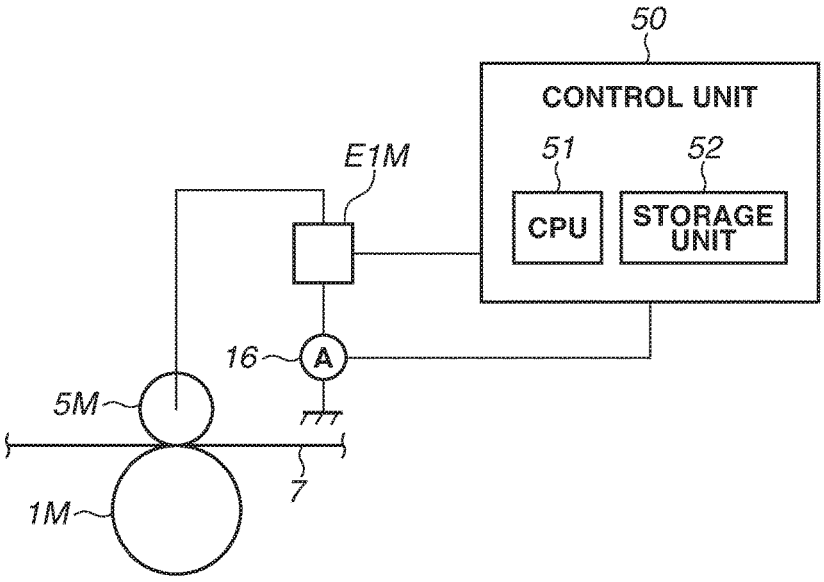

As a resistance detection unit for detecting an index value correlated with the electrical resistance of the intermediate transfer belt 7, a unit for detecting the value of a current flowing when a predetermined voltage is applied to the primary transfer roller 5 or the value of a voltage generated when a predetermined current is sent to the primary transfer roller 5. The resistance detection unit enables obtaining the information correlated with the electrical resistance of mainly the intermediate transfer belt 7 and the primary transfer roller 5 at the primary transfer portion N1, i.e., the electrical resistance of at least the intermediate transfer belt 7. The resistance detection unit can be provided for at least one primary transfer portion N1. More specifically, according to the present exemplary embodiment, an ammeter 16 as a current detection unit is connected at least to the primary transfer power source E1M, as illustrated in FIG. 5B When the primary transfer power source E1M applies a predetermined voltage under constant voltage control to the primary transfer roller 5M, the control unit 50 can acquire information about the current measured by the ammeter 16. According to the present exemplary embodiment, the predetermined voltage is set to +1000 V. It is desirable to perform the detection of the information correlated with the electrical resistance of the intermediate transfer belt 7 in the non-image forming time period. According to the present exemplary embodiment, the detection is performed in the pre-rotation process before image formation in a job According to the present exemplary embodiment, the control unit 50 calculates the electrical resistance value based on the applied voltage value and the detected current value. Then, the control unit 50 performs control to determine the value of the second voltage applied to the primary transfer roller 5M according to the electrical resistance value.

Table 4 illustrates the relation between the measured value of the electrical resistance and the value of the second voltage applied to the primary transfer roller 5M. According to the present exemplary embodiment, the value of the negative primary transfer voltage applied to the primary transfer roller 5Y is fixed to −1.0 kV. As illustrated in Table 4, with a relatively small measured value of the electrical resistance, it is desirable to relatively increase the absolute value of the second voltage applied to the primary transfer roller 5M. More specifically, the control unit 50 acquires the information correlated with the electrical resistance of the intermediate transfer belt 7, and changes the second voltage based on the information correlated with the electrical resistance. In this case, typically, the control unit 50 changes the second voltage so that the absolute value of the second voltage in the case of a second electrical resistance (lower than a first electrical resistance) of the intermediate transfer belt 7 becomes larger than the absolute value of the second voltage in the case of the first electrical resistance of the intermediate transfer belt 7.

TABLE 4

| Measured value of electrical resistance | Second voltage |
|---|---|
| 0 to 9 MΩ | +900 V |
| Up to 20 MΩ | +800 V |
| Up to 30 MΩ | +700 V |

The information indicating the relation illustrated in Table 4 is preset and stored in the storage unit 52. When switching the voltage applied to the primary transfer roller 5M from the first to the second voltage, the control unit 50 determines the value of the second voltage applied to the primary transfer roller 5M according to the information about the electrical resistance value measured in the pre-rotation time period, based on the information indicating the relation illustrated in Table 4. For example, when the measured value of the electrical resistance is 5 mega ohms (MΩ), the control unit 50 determines the value of the second voltage as +900 V.

As described above, according to the present exemplary embodiment, the primary transfer voltage applied to the primary transfer roller SM can be changed to a more suitable value according to the information correlated with the electrical resistance of the intermediate transfer belt 7.

When switching the primary transfer voltage applied to the primary transfer rollers 5C and 5K, the value of the second voltage can also be similarly changed according to the information correlated with the electrical resistance of the intermediate transfer belt 7.

Although, in the present exemplary embodiment, the electrical resistance value is calculated as information correlated with the electrical resistance of the intermediate transfer belt 7, the detected current value, for example, can also be used for processing as long as the value is an index value correlated with the electrical resistance of the intermediate transfer belt 7.

The resistance detection unit is not limited to the one according to the present exemplary embodiment. For example, a roller pair for sandwiching the intermediate transfer belt 7 like the primary transfer portion N1 may be separately provided, and the voltage-current characteristics may be measured by using the roller pair to estimate the electrical resistance.

In addition to the information correlated with the electrical resistance of the intermediate transfer belt 7, the second voltage may be changed according to at least either one of the information correlated with the use amount of the photosensitive member 1 according to the second exemplary embodiment or the information about the atmospheric environment according to the third exemplary embodiment. More specifically, control described in the first to the fourth exemplary embodiments can be arbitrarily combined.

Other Embodiments

Although the present disclosure has been described above based on specific exemplary embodiments, the present disclosure is not limited to the above-described exemplary embodiments.

Figure 6:
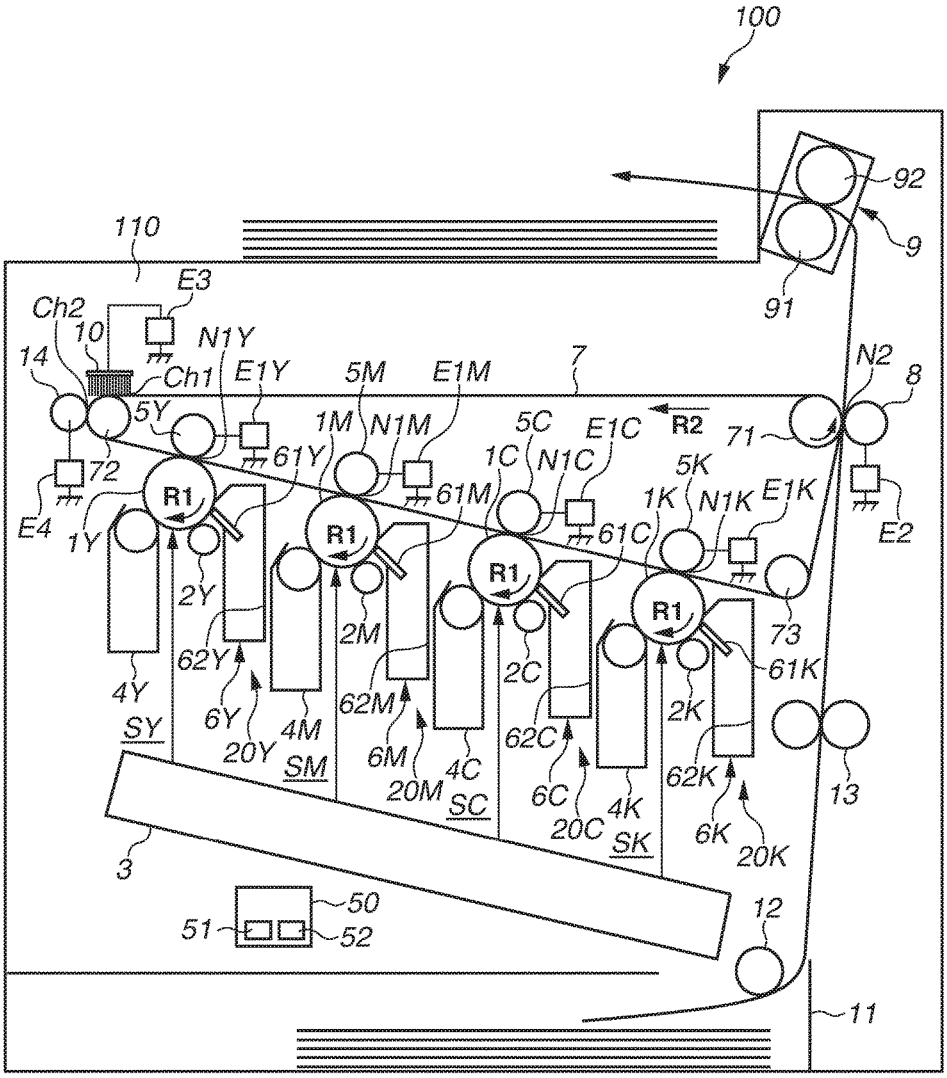
FIG. 6 is a longitudinal sectional view schematically illustrating another example of the image forming apparatus.

According to the above-described exemplary embodiments, the image forming apparatus 100 includes a cleaning brush as a charging unit for charging toner on the intermediate transfer member. For example, if a comparatively large amount of residual toner occurs making it difficult to sufficiently charge the residual toner only with the cleaning brush, a plurality of charging units may be provided. For example, in addition to the cleaning brush 10 as a first charging unit, the image forming apparatus 100 may have a cleaning roller 14, formed of a roller type charge member as a second charging unit, as illustrated in FIG. 6. In the example illustrated in FIG. 6, the cleaning brush 10 charges the toner on the intermediate transfer belt 7 at a first charging portion Ch1 in a similar way to the above-described exemplary embodiments. The cleaning roller 14 is disposed to charge the toner on the intermediate transfer belt 7 at a second charging portion Ch2 on the downstream side of the first charging portion Ch1 and on the upstream side of the primary transfer portion N1 (primary transfer portion N1Y on the most upstream side) in the moving direction of the intermediate transfer belt 7. Particularly in the example illustrated in the FIG. 6, the cleaning brush 10 and the cleaning roller 14 are disposed in contact with the surface of the intermediate transfer belt 7 at positions facing the tension roller 72 via the intermediate transfer belt 7. The cleaning roller 14 is connected with the second charging power source E4. In synchronization with the first charging power source E3 corresponding to the charging power source according to the above-described exemplary embodiments, the cleaning roller 14 can be applied with a voltage having the polarity identical to the voltage from the first charging power source E3. This allows the cleaning roller 14 to charge the residual toner that has not been sufficiently charged by the cleaning brush 10. Similar to the case of the cleaning brush 10, the toner accumulated on the cleaning roller 14 can be discharged to the intermediate transfer belt 7. The cleaning roller 14 can be a solid rubber roller having an electrical resistance adjusted to 105 to 109 ohms (Ω). The second charging power source (high-voltage power supply circuit) E4 enables applying, for example, a voltage (charging bias) of −2.0 to +2.0 kV to the cleaning roller 14.

Although, in the above-described exemplary embodiments, the primary transfer member is a roller-like member, the member is not limited thereto and may have other forms, such as the shape of a blade, the shape of a brush, and the shape of a film.

Although, in the above-described exemplary embodiments, the intermediate transfer member is an endless belt stretched by a plurality of stretching rollers, the member is not limited thereto and may have other forms, such as a drum-like film disposed on a frame in a stretched way. The photosensitive members may not be limited to the shape of a drum, and may have, for example, the shape of an endless belt. The image bearing members may be electrostatic recording dielectric bodies.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-178957, filed Sep. 13, 2016, which is hereby incorporated by reference herein in its entirety.

What is claimed is:

1. An image forming apparatus comprising:

a movable intermediate transfer member;

a first image bearing member configured to bear a toner image;

a second image bearing member disposed on a downstream side of the first image bearing member in a moving direction of the intermediate transfer member, and configured to bear a toner image;

a first primary transfer device configured to form a first primary transfer portion with the first image bearing member via the intermediate transfer member, and primarily transfer a toner image from the first image bearing member to the intermediate transfer member;

a second primary transfer device configured to form a second primary transfer portion with the second image bearing member via the intermediate transfer member, and primarily transfer a toner image from the second image bearing member to the intermediate transfer member;

a first transfer power source configured to apply a voltage to the first primary transfer device;

a second transfer power source configured to apply a voltage to the second primary transfer device;

a secondary transfer device configured to form a secondary transfer portion with the intermediate transfer member, and secondarily transfer a toner image from the intermediate transfer member onto a transfer material;

a charging device disposed on a downstream side of the secondary transfer portion for secondarily transferring a toner image from the intermediate transfer member onto a transfer material and on an upstream side of the first primary transfer portion in the moving direction, and configured electrically charge toner on the intermediate transfer member;

a charging power source configured to apply a voltage to the charging device; and a control device configured to control at least the first transfer power source and the second transfer power source, wherein, the control device switches a polarity of the voltage applied by the first transfer power source in response to a switching of a polarity of a voltage applied by the charging power source, and switches the voltage applied by the second transfer power source from a first voltage to a second voltage which is larger in absolute value than the first voltage.

2. The image forming apparatus according to claim 1, wherein, before a primary transfer at the second primary transfer portion is completed for all toner images in a job, the control device switches the polarity of the voltage applied by the charging power source from a polarity opposite to a toner's normal charging polarity to a polarity identical to the toner's normal charging polarity, and wherein the control device switches the polarity of the voltage applied by the first transfer power source from a polarity opposite to the toner's normal charging polarity to a polarity identical to the toner's normal charging polarity in response to the switching of the polarity of the voltage applied by the charging power source from the opposite polarity to the identical polarity, and switches the voltage applied by the second transfer power source from the first voltage applied when the first transfer power source is applying the voltage of the opposite polarity, to the second voltage applied when the first transfer power source is applying the voltage of the identical polarity which is larger in absolute value than the first voltage.

3. The image forming apparatus according to claim 2, wherein, after the primary transfer at the first primary transfer portion is completed for all toner images in the job, the control device switches the polarity of the voltage applied by the first transfer power source from the opposite polarity to the identical polarity.

4. The image forming apparatus according to claim 2, during a time period since a time when the switching of the voltage applied by the first transfer power source from the opposite polarity to the identical polarity is started till a time when the switching is completed, the control device completes the switching of the voltage applied by the second transfer power source from the first voltage to the second voltage.

5. The image forming apparatus according to claim 4, wherein, at predetermined time before starting the switching of the polarity of the voltage applied by the first transfer power source from the opposite polarity to the identical polarity, the control device starts the switching of the voltage applied by the second transfer power source from the first voltage to the second voltage.

6. The image forming apparatus according to claim 2, wherein, when the voltage of the opposite polarity is applied to the first primary transfer device, the toner on the intermediate transfer member charged to the opposite polarity by the charging unit to which the voltage of the opposite polarity is applied is transferred from the intermediate transfer member to the first image bearing member at the first primary transfer portion and then collected, and wherein, when the voltage of the identical polarity is applied to the first primary transfer device, the toner on the intermediate transfer member charged to the identical polarity by the charging unit to which the voltage of the identical polarity is applied or the toner charged to the identical polarity and moved from the charging device to the intermediate transfer member is transferred from the intermediate transfer member to the first image bearing member at the first primary transfer portion and then collected.

7. The image forming apparatus according to claim 1, wherein the control device changes the second voltage according to an absolute value of the voltage applied by the first transfer power source.

8. The image forming apparatus according to claim wherein the control device changes the second voltage so that an absolute value of the second voltage in a case of a second absolute value larger than a first absolute value of the voltage of the identical polarity applied by the first transfer power source becomes larger than the absolute value of the second voltage in a case of the first absolute value of the voltage of the identical polarity applied y the first transfer power source.

9. The image forming apparatus according to claim 1, wherein the control device acquires information correlated with a use amount of the second image bearing member, and changes the second voltage based on the information correlated with the use amount.

10. The image forming apparatus according to claim 9, wherein the control device changes the second voltage so that the absolute value of the second voltage in a case of a second use amount which is larger than a first use amount becomes smaller than the absolute value of the second voltage in a case of the first use amount.

11. The image forming apparatus according to claim 1, wherein the control device acquires information about an atmospheric environment, and changes the second voltage based on the information about the atmospheric environment.

* * * * *